US008240063B2

(12) United States Patent
Grimes

(10) Patent No.: US 8,240,063 B2
(45) **Date of Patent: *Aug. 14, 2012**

(54) CLEANING WRINGING AND DRYING APPARATUS

(76) Inventor: David Brian Grimes, Greenfield, MA (US)

( * ) Notice: Subject to any disclaimer, the term of this patent is extended or adjusted under 35 U.S.C. 154(b) by 943 days.

This patent is subject to a terminal disclaimer.

(21) Appl. No.: 11/780,540

(22) Filed: Jul. 20, 2007

(65) Prior Publication Data

US 2008/0010767 A1 Jan. 17, 2008

Related U.S. Application Data

(62) Division of application No. 10/985,827, filed on Nov. 10, 2004, now Pat. No. 7,269,875.

(51) Int. Cl.
*F26B 5/16* (2006.01)

(52) U.S. Cl. ..... 34/381; 34/413; 34/497; 15/119.1; 15/120.1

(58) Field of Classification Search ..... 34/90, 380, 34/381, 413, 416, 497, 524; 15/119.1, 120.1
See application file for complete search history.

(56) References Cited

U.S. PATENT DOCUMENTS

| | | | | | |
|---|---|---|---|---|---|
| 614,749 | A | * | 11/1898 | Pallas | 138/93 |
| 856,063 | A | * | 6/1907 | Howell | 15/104.16 |
| 1,088,459 | A | * | 2/1914 | Shade | 138/93 |
| 1,384,305 | A | * | 7/1921 | Meador et al. | 166/141 |
| 1,432,134 | A | * | 10/1922 | Sweetland | 210/203 |
| 1,510,212 | A | * | 9/1924 | Du Bois | 15/104.31 |
| 1,513,228 | A | * | 10/1924 | Crotto | 166/185 |
| 1,558,572 | A | * | 10/1925 | Badeaux | 34/106 |
| 1,641,204 | A | * | 9/1927 | Shattuck | 68/244 |
| 1,645,050 | A | * | 10/1927 | Henderson | 426/138 |
| 1,654,253 | A | * | 12/1927 | Henderson | 264/558 |
| 1,709,622 | A | | 3/1928 | Justis | |
| 1,690,577 | A | * | 11/1928 | Hammond, Jr. | 84/88 |
| 1,848,269 | A | * | 3/1932 | Petersen | 15/104.31 |
| 1,881,005 | A | * | 10/1932 | Watkins | 118/500 |
| 2,033,355 | A | * | 3/1936 | Peterson | 68/27 |
| 2,046,335 | A | * | 7/1936 | Manson | 441/96 |
| 2,095,912 | A | * | 10/1937 | Boyd | 137/223 |
| 2,126,275 | A | * | 8/1938 | Ogillby | 521/72 |
| 2,144,793 | A | * | 1/1939 | Christensen | 68/244 |
| 2,204,122 | A | * | 6/1940 | Colley | 244/134 A |
| 2,207,926 | A | * | 7/1940 | Lang | 68/21 |
| 2,265,516 | A | * | 12/1941 | Chayie | 68/21 |
| 2,304,419 | A | * | 12/1942 | Pratt | 198/835 |
| 2,337,581 | A | * | 12/1943 | Wiley | 425/347 |
| 2,345,144 | A | * | 3/1944 | Opavsky | 264/570 |
| 2,373,899 | A | * | 4/1945 | Lejeune | 156/213 |
| 2,410,485 | A | * | 11/1946 | Du Nah | 223/67 |
| 2,424,044 | A | * | 7/1947 | Miller | 451/301 |

(Continued)

FOREIGN PATENT DOCUMENTS

FR 2663963 A1 * 1/1992

*Primary Examiner* — Stephen M. Gravini
(74) *Attorney, Agent, or Firm* — McCormick, Paulding & Huber LLP

(57) ABSTRACT

Fluid is removed from the cleaning element of such as a sponge mop or string mop by inflating a bladder or like expansible member which is positioned in an enclosure adjacent the cleaning element, causing the expansible member to expand into contact with the cleaning element, thereby compressing the cleaning element for squeezing fluid therefrom.

11 Claims, 8 Drawing Sheets

U.S. PATENT DOCUMENTS

| | | | | | |
|---|---|---|---|---|---|
| 2,514,321 | A | * | 7/1950 | Fekete | 68/244 |
| 2,540,986 | A | * | 2/1951 | Klein et al. | 425/71 |
| 2,545,832 | A | * | 3/1951 | Wagers et al. | 156/241 |
| 2,592,330 | A | * | 4/1952 | Quartullo et al. | 68/21 |
| 2,642,602 | A | * | 6/1953 | Kelly | 15/104.16 |
| 2,673,168 | A | * | 3/1954 | Pascoe et al. | 100/172 |
| 2,685,190 | A | * | 8/1954 | Whittington | 68/242 |
| 2,685,971 | A | * | 8/1954 | Ewing et al. | 414/738 |
| 2,785,041 | A | * | 3/1957 | Riches | 8/116.1 |
| 2,817,228 | A | * | 12/1957 | Koplin | 68/242 |
| 2,878,020 | A | * | 3/1959 | Robinson | 473/535 |
| 2,931,290 | A | * | 4/1960 | Davidson | 100/211 |
| 2,944,547 | A | * | 7/1960 | Kish et al. | 128/203.21 |
| 2,983,944 | A | | 5/1961 | Uselis | |
| 3,212,177 | A | * | 10/1965 | Thomas | 29/235 |
| 3,224,734 | A | * | 12/1965 | Hill | 254/134.6 |
| 3,307,966 | A | * | 3/1967 | Shoaf | 428/395 |
| 3,398,417 | A | * | 8/1968 | Erwin | 15/104.19 |
| 3,424,611 | A | * | 1/1969 | Miller | 127/2 |
| 3,447,174 | A | * | 6/1969 | Candor et al. | 8/158 |
| 3,452,949 | A | * | 7/1969 | Bassett et al. | 244/31 |
| 3,491,386 | A | * | 1/1970 | Candor et al. | 8/158 |
| 3,506,522 | A | * | 4/1970 | Ardolino et al. | 156/432 |
| 3,603,122 | A | * | 9/1971 | Sulzmann | 68/264 |
| 3,693,740 | A | * | 9/1972 | Lewis et al. | 180/8.1 |
| 3,816,070 | A | * | 6/1974 | Candor et al. | 8/158 |
| 3,845,795 | A | * | 11/1974 | Andreasson | 141/313 |
| 3,872,695 | A | * | 3/1975 | Busek | 69/47 |
| 3,946,457 | A | | 3/1976 | Robinson | |
| 4,292,974 | A | * | 10/1981 | Fogarty et al. | 606/194 |
| 4,315,818 | A | * | 2/1982 | Thomas | 210/242.3 |
| 4,322,865 | A | | 4/1982 | Von Meyer | |
| 4,368,816 | A | * | 1/1983 | Albee | 198/624 |
| 4,471,500 | A | * | 9/1984 | Long et al. | 4/499 |
| 4,572,364 | A | * | 2/1986 | Jordan | 206/287 |
| 4,770,095 | A | * | 9/1988 | Schofield | 100/170 |
| 4,807,653 | A | * | 2/1989 | Cipriano et al. | 134/64 R |
| 4,817,228 | A | | 4/1989 | Von Meyer | |
| 4,858,629 | A | * | 8/1989 | Cundari | 131/332 |
| 4,917,311 | A | * | 4/1990 | Yoshino et al. | 241/36 |
| 4,928,589 | A | * | 5/1990 | Schofield | 100/170 |
| 4,971,471 | A | | 11/1990 | Sloan | |
| 4,976,119 | A | * | 12/1990 | Hartmann | 68/242 |
| 5,060,338 | A | | 10/1991 | Yates et al. | |
| 5,073,418 | A | * | 12/1991 | Thornton et al. | 428/34.9 |
| 5,102,415 | A | * | 4/1992 | Guenther et al. | 606/159 |
| 5,131,111 | A | | 7/1992 | Richardson et al. | |
| 5,196,001 | A | * | 3/1993 | Kao | 604/416 |
| 5,235,713 | A | * | 8/1993 | Guthrie et al. | 5/710 |
| 5,285,806 | A | * | 2/1994 | Ortega | 137/15.08 |
| 5,350,000 | A | * | 9/1994 | Wang | 150/166 |
| 5,501,248 | A | * | 3/1996 | Kiest, Jr. | 138/98 |
| 5,509,163 | A | | 4/1996 | Morad | |
| 5,558,672 | A | * | 9/1996 | Edwards et al. | 606/41 |
| 5,569,241 | A | * | 10/1996 | Edwards | 606/41 |
| 5,581,839 | A | | 12/1996 | Ferrell, Jr. | |
| 5,673,408 | A | * | 9/1997 | Shebanow et al. | 712/216 |
| 5,675,858 | A | | 10/1997 | Von Meyer | |
| 5,690,253 | A | * | 11/1997 | LaFleur | 222/102 |
| D387,526 | S | | 12/1997 | Berti et al. | |
| 5,735,289 | A | * | 4/1998 | Pfeffer et al. | 600/564 |
| 5,753,108 | A | * | 5/1998 | Haynes et al. | 210/122 |
| 5,787,734 | A | * | 8/1998 | Vinas | 68/18 F |
| 5,830,539 | A | * | 11/1998 | Yan et al. | 427/551 |
| 5,855,729 | A | * | 1/1999 | Kiest et al. | 156/423 |
| 5,885,451 | A | * | 3/1999 | Porrovecchio, Sr. | 210/242.4 |
| 5,902,003 | A | * | 5/1999 | Hindson | 296/136.02 |
| 5,907,883 | A | * | 6/1999 | Thomasson | 15/120.2 |
| 5,964,755 | A | * | 10/1999 | Edwards | 606/41 |
| 5,964,985 | A | * | 10/1999 | Wootten | 201/40 |
| 5,974,617 | A | | 11/1999 | Chang | |
| 6,013,158 | A | * | 1/2000 | Wootten | 202/99 |
| D421,514 | S | * | 3/2000 | Camp et al. | D32/40 |
| 6,041,863 | A | * | 3/2000 | Lindsey | 166/311 |
| 6,066,937 | A | * | 5/2000 | Gutierrez et al. | 320/104 |
| 6,071,460 | A | * | 6/2000 | Renaudin et al. | 264/314 |
| 6,108,848 | A | | 8/2000 | Monahan | |
| 6,115,869 | A | | 9/2000 | Libman | |
| 6,206,993 | B1 | * | 3/2001 | Kiest et al. | 156/156 |
| 6,212,728 | B1 | | 4/2001 | Facca et al. | |
| 6,219,871 | B1 | * | 4/2001 | Frederick et al. | 8/159 |
| 6,243,074 | B1 | * | 6/2001 | Fishkin et al. | 345/156 |
| 6,243,075 | B1 | * | 6/2001 | Fishkin et al. | 345/156 |
| 6,268,857 | B1 | * | 7/2001 | Fishkin et al. | 715/863 |
| 6,286,172 | B1 | | 9/2001 | Castagnoli | |
| 6,297,805 | B1 | * | 10/2001 | Adler et al. | 345/158 |
| 6,297,838 | B1 | * | 10/2001 | Chang et al. | 715/863 |
| 6,315,776 | B1 | * | 11/2001 | Edwards et al. | 606/41 |
| 6,332,229 | B1 | * | 12/2001 | O'Malley et al. | 4/438 |
| 6,550,094 | B1 | * | 4/2003 | Hurtado | 15/119.2 |
| D474,869 | S | | 5/2003 | Libman | |
| 6,629,445 | B2 | * | 10/2003 | Yamanaka et al. | 73/1.13 |
| 6,630,922 | B2 | * | 10/2003 | Fishkin et al. | 345/156 |
| 6,641,676 | B1 | * | 11/2003 | Bently | 134/6 |
| D486,364 | S | * | 2/2004 | Shaltiel | D8/14 |
| 6,725,957 | B2 | * | 4/2004 | Sutton | 180/89.14 |
| 6,785,927 | B2 | | 9/2004 | Lesley et al. | |
| 6,786,144 | B2 | * | 9/2004 | Williams | 100/168 |
| 6,840,955 | B2 | * | 1/2005 | Ein | 607/108 |
| 6,873,866 | B2 | * | 3/2005 | Briandet et al. | 600/407 |
| 6,927,858 | B2 | * | 8/2005 | Boone et al. | 356/437 |
| D511,948 | S | * | 11/2005 | Shaltiel | D8/14 |
| 7,082,578 | B1 | * | 7/2006 | Fishkin et al. | 715/863 |
| 7,135,617 | B2 | * | 11/2006 | Lardizabal et al. | 800/281 |
| 7,269,875 | B1 | * | 9/2007 | Grimes | 15/119.2 |
| 7,311,148 | B2 | * | 12/2007 | Giroux et al. | 166/285 |
| 7,350,256 | B2 | * | 4/2008 | Benjamin et al. | 15/104.94 |
| 7,490,382 | B2 | * | 2/2009 | Benjamin et al. | 15/104.94 |
| 2002/0002855 | A1 | * | 1/2002 | Yamanaka et al. | 73/1.13 |
| 2002/0026226 | A1 | * | 2/2002 | Ein | 607/108 |
| 2002/0068934 | A1 | * | 6/2002 | Edwards et al. | 606/41 |
| 2002/0133892 | A1 | | 9/2002 | Monahan | |
| 2002/0178936 | A1 | * | 12/2002 | Williams | 100/155 R |
| 2003/0073930 | A1 | * | 4/2003 | Morrissey et al. | 600/573 |
| 2003/0132541 | A1 | * | 7/2003 | Zamonski | 264/36.14 |
| 2003/0213079 | A1 | | 11/2003 | Libman et al. | |
| 2004/0001204 | A1 | * | 1/2004 | Boone et al. | 356/437 |
| 2004/0167375 | A1 | * | 8/2004 | Couvillon, Jr. | 600/17 |
| 2004/0221997 | A1 | * | 11/2004 | Giroux et al. | 166/380 |
| 2004/0249273 | A1 | * | 12/2004 | Briandet et al. | 600/431 |
| 2005/0125877 | A1 | * | 6/2005 | Benjamin et al. | 2/158 |
| 2005/0125923 | A1 | * | 6/2005 | Benjamin et al. | 15/104.94 |
| 2005/0125924 | A1 | * | 6/2005 | Benjamin et al. | 15/104.94 |
| 2005/0129743 | A1 | * | 6/2005 | Benjamin et al. | 424/443 |
| 2005/0267529 | A1 | * | 12/2005 | Crockett et al. | 606/215 |
| 2006/0016768 | A1 | * | 1/2006 | Grichar et al. | 210/780 |
| 2006/0041183 | A1 | * | 2/2006 | Massen et al. | 600/16 |
| 2006/0041309 | A1 | * | 2/2006 | Massen et al. | 623/14.13 |
| 2006/0218056 | A1 | * | 9/2006 | Dickman | 705/28 |
| 2006/0241334 | A1 | * | 10/2006 | Dubi et al. | 600/16 |
| 2007/0048345 | A1 | * | 3/2007 | Huang et al. | 424/405 |
| 2007/0148320 | A1 | * | 6/2007 | Uchiyama | 426/634 |
| 2007/0252042 | A1 | * | 11/2007 | Smith et al. | 244/149 |
| 2008/0010767 | A1 | * | 1/2008 | Grimes | 15/119.2 |
| 2008/0027888 | A1 | * | 1/2008 | Azzam et al. | 706/45 |
| 2008/0128140 | A1 | * | 6/2008 | Giroux et al. | 166/381 |
| 2008/0149504 | A1 | * | 6/2008 | Benjamin et al. | 206/223 |
| 2008/0224000 | A1 | * | 9/2008 | Yang | 248/188.5 |
| 2008/0290865 | A1 | * | 11/2008 | Fujita et al. | 324/230 |
| 2008/0319256 | A1 | * | 12/2008 | Mortier et al. | 600/37 |
| 2009/0025215 | A1 | * | 1/2009 | Murakami et al. | 29/846 |
| 2009/0105543 | A1 | * | 4/2009 | Miller et al. | 600/155 |
| 2009/0133206 | A1 | * | 5/2009 | Benjamin et al. | 15/227 |
| 2009/0133793 | A1 | * | 5/2009 | Bergman et al. | 152/458 |

* cited by examiner

CLEANING WRINGING AND DRYING APPARATUS

CROSS-REFERENCE TO RELATED APPLICATIONS

This is a divisional application of U.S. application Ser. No. 10/985,827 filed Nov. 10, 2004.

FIELD OF THE INVENTION

The present invention relates to cleaning apparatus in the nature of mops and the like and more particularly to the means for removing fluid therefrom.

BACKGROUND OF THE INVENTION

The prior art shows a variety of floor mop constructions for "wringing" or removing fluid from sponge-type mops, with the majority of the structures employing pressure plates or rollers which are activated by lever arms to press against the mop head. Typical of such constructions are U.S. Pat. Nos. 5,131,111 and 5,974,617.

In U.S. Pat. Nos. 4,322,865 and 4,817,228, pistons mounted in a mop handle are activated to create a vacuum in a mop head causing the walls of the mop head to collapse, thereby causing presser plates, which are pivotally connected thereto to compress an attached sponge.

String-type mops of the prior art, such as those disclosed in U.S. Pat. Nos. 1,709,622 and 5,675,858, and Design No. 387,526, employ collars or sleeves which are slideably mounted on the mop handle and are forced over the mop head and twisted or rotated to remove fluid therefrom.

In U.S. Pat. No. 6,286,172, an air bladder is inserted into an air duct and inflated and pulled along the duct for removing dirt and debris from the duct.

The prior art fails to provide cleaning apparatus, which is lightweight, employs no pressure plates or levers or rollers to effect wringing and requires no bending during use.

SUMMARY OF THE INVENTION

A primary object of the invention is to provide a lightweight cleaning apparatus wherein a resilient material such as a sponge or the like is compressed by the use of a compressed gas which expands in an expansible member, such as a bladder or air bag to force the resilient member against a restraining member which limits such expansion thereby converting the outward expansion of the expansible member into circumferential stress in the resilient member so that the resilient member is compressed without the use of rigid compression plates, hinges or levers.

Another object is to provide cleaning apparatus, such as a mop, which requires no bending during use and does not fold over on itself when it is wrung, as is the case with so-called "butterfly" sponge mops of the prior art.

With the apparatus hereof, cleaning fluid can be carried by the apparatus to the area of desired application and the apparatus wrung out and the fluid soaked back up prior to lifting the apparatus from the application site.

As another advantage, the device of the invention can be pre-filled at manufacture with wax or cleaning fluids or other chemicals and used as an applicator. The device carries an integral pump, which can be operated while the applicator is in contact with such as a floor or vehicle or other object being treated or cleaned.

A further object is to provide a cleaning apparatus which may so designed that a mop head is allowed to pivot without interfering with a wringing operation, thereby allowing its use in cleaning hard-to-reach areas such as cabinets and large vehicles.

With the cleaning apparatus hereof, introduction of a compressed gas into an expansible member forces out an even flow of fluid from an applicator over the surface being treated.

In one of its embodiments, a collapsed bladder and an open pore sponge are disposed in a flexible, porous, but non-stretchable, cylindrical sheath to form a cleaning member which is pivotally attached to the lower end of a handle, with inflation of the bladder being effected by means of a pump mounted on the handle. Injection of compressed gas into the bladder by the pump causes the bladder to expand, with the sheath serving to limit such expansion whereby the sponge is squeezed against the sheath to wring fluid from the sponge.

In this embodiment of the invention, while the porous sheath limits the expansion of the bladder, it does permit the passage of fluid therethrough so that the sponge may be easily and repeatedly wrung out, with the design permitting the fluid to be forced out through the sheath at the point of greatest contact of the sheath with the surface being treated.

In another embodiment, a string-mop attached to the lower end of a handle is wrung by positioning a cylindrical sheath having an integral, bell-shaped expansible gas chamber in surrounding manner adjacent the strings or strands of the mop head. The gas chamber is inflated by means of a pump mounted on the handle. Injection of compressed gas into the air chamber causes a flexible diaphragm or bladder thereof to expand against the strands thereby squeezing the adjacent strands to wring fluid therefrom.

DETAILED DESCRIPTION OF THE PREFERRED EMBODIMENTS

Figure 1:
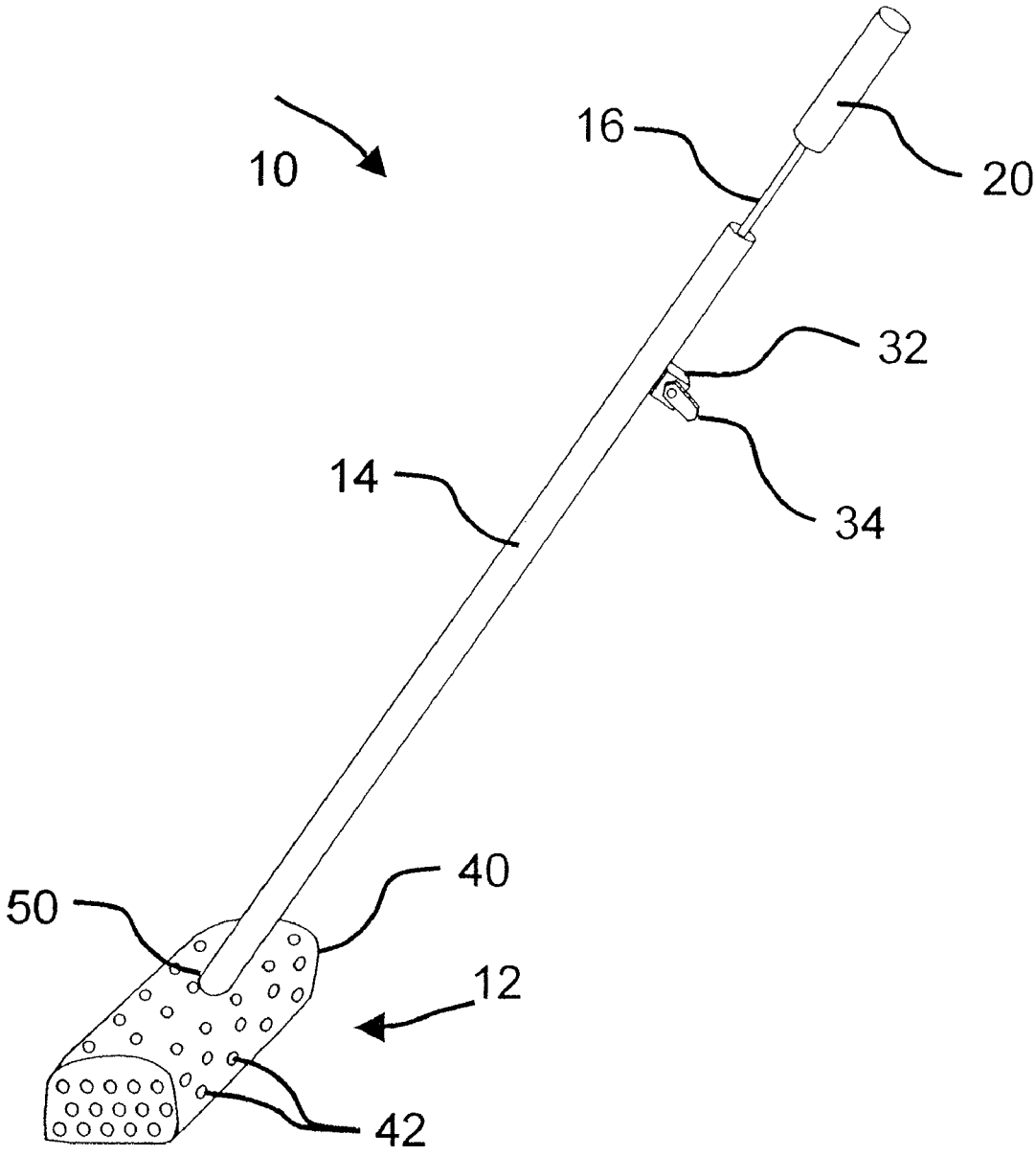
FIG. 1 is a perspective view of a preferred form of the invention as embodied in cleaning apparatus of the sponge-mop type.

Referring to FIGS. 1-4 of the drawings, a preferred form of the invention is embodied in cleaning apparatus of the sponge mop type generally indicated by 10 and comprising a cleaning head, generally indicated by 12, which is attached to the lower end of a tubular handle 14 which sleeves a piston shaft 16 having a piston 18 attached to a lower end thereof and a handgrip 20 attached to an upper free end thereof.

Handle 14 serves as a cylinder for piston 18, whereby the handle and piston can act as a pump.

While a manually operated pump has been shown and described, an electrically-operated pump may be employed.

Piston shaft 16 passes centrally though a cap 22 which closes off the upper end of handle 14, with the cap having a vent hole 24 therein.

A high-pressure outlet valve 26, having a central passage 28 of decreased diameter extending longitudinally therethrough, is provided in handle 14.

A spring-loaded check valve 30 is positioned in handle 14 immediately below the lower end of piston 18 and the upper end of high-pressure outlet valve 26 to prevent the back flow of air.

A lever-operated ball valve 32 is fixed to handle 14 adjacent the upper end of high pressure outlet valve 26, with the ball valve being moveable by a lever 34 to bring a port 36 which passes through the ball valve into and out of alignment with a vent passage 38 which communicates with through passage 28 of high pressure outlet valve 26 to allow air from the high pressure side of the pump to be vented to atmosphere.

Cleaning head 12 includes a closed-end, cylindrical, flexible, porous, non-stretchable outer sheath 40, which has a plurality of openings 42 therein for permitting the passage of fluid therethrough.

Outer sheath 40 encases a resilient cleaning member 44, such as an open-pore sponge or the like, and a flexible, expansible member 46, such as a bladder or air bag or the like, with the cleaning member being positioned between the outer sheath and the expansible member.

Cleaning head 12 is connected to handle 14 by a transversely-extending plate 48 provided on the lower end of the handle and inserted into a provided opening 50 in the upper wall of outer sheath 40 of the cleaning head, with plate 48 having a central opening 52 therein which affords communication between through passage 28 of high pressure outlet valve 26 in the handle and an inlet neck 54 located centrally on the upper surface of flexible, expansible member 46.

In operation, lever 34 is moved to close ball valve 32 and hand grip 20 is manually reciprocated to effect concomitant movement of piston 18 thereby forcing air or gas through high pressure outlet valve 26 and into flexible, expansible member 46 thereby inflating that member and causing it to expand.

Expansion of expansible member 46 compresses resilient cleaning member 44 against outer sheath 40 to reduce the volume of the cleaning member and to force fluid F from the cleaning member through openings 42 in the outer sheath.

The piston compression ratio of the cleaning apparatus hereof can be controlled at manufacture to provide a very minimal strength requirement for its use, making it much more suitable for use by older adults than other presently available mop wringers.

Referring to FIGS. 5-9 of the drawings, a first modified form of the invention is embodied in cleaning apparatus of the string-mop type generally indicated by 100 and comprising a cleaning head 112, a handle 114, a reciprocating gas pump assembly 116 and a wringer assembly 118.

Cleaning head 112 is fixed to the lower end of handle 114 and has a plurality of flexible, absorbent strands 113 extending downwardly and outwardly therefrom in known manner.

Reciprocating gas pump assembly 116 is fixed to and is disposed in side-by-side relation to wringer assembly 118 and includes a piston shaft 120 attached to a piston, not shown, disposed in a closed cylinder 122.

While a manually operated, reciprocating pump is shown and described, an electrically operated pump may be employed.

Figure 5:
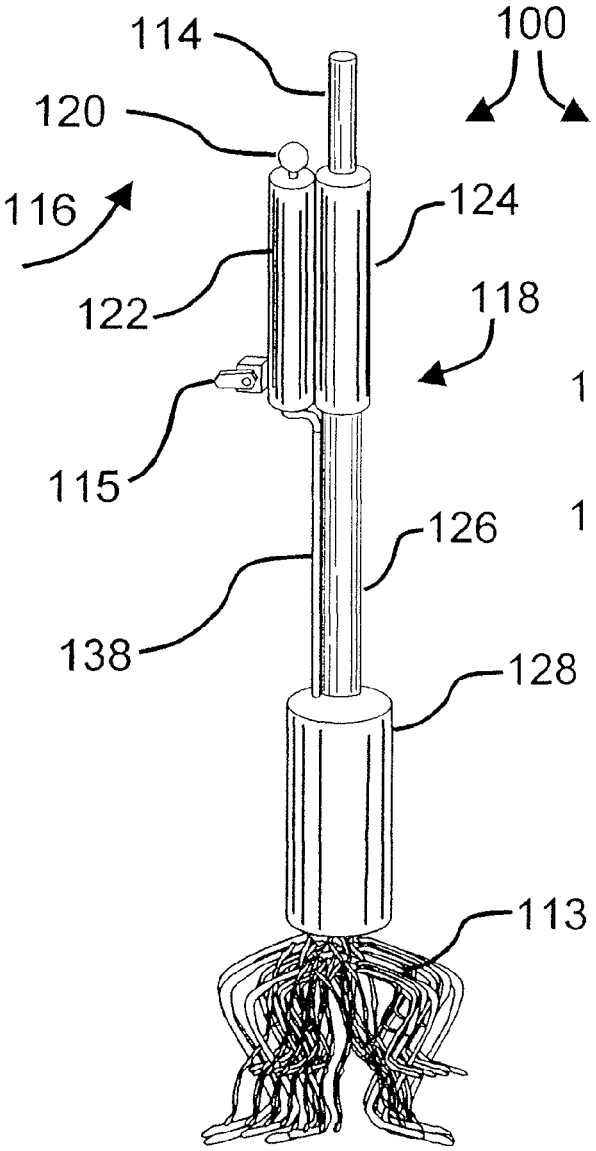
FIG. 5 is a perspective view of a first modified form of the invention as embodied in cleaning apparatus of the string-mop type.
Figure 6:
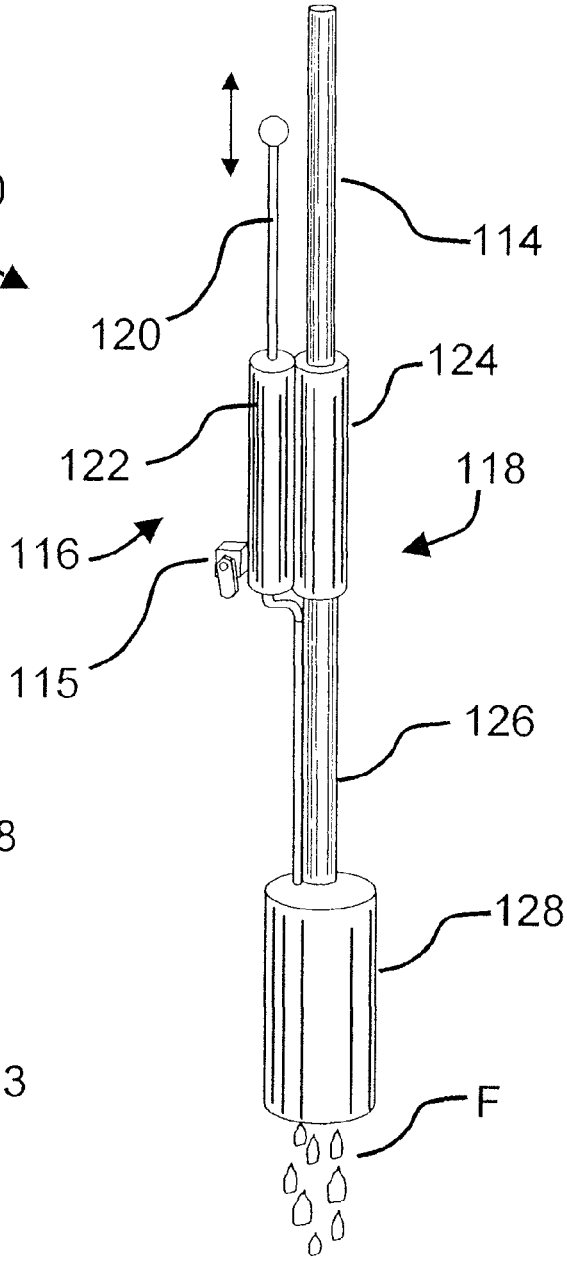
FIG. 6 is a perspective view similar to FIG. 5, with the cleaning apparatus being shown in a position wherein fluid is wrung therefrom.
Figure 7:
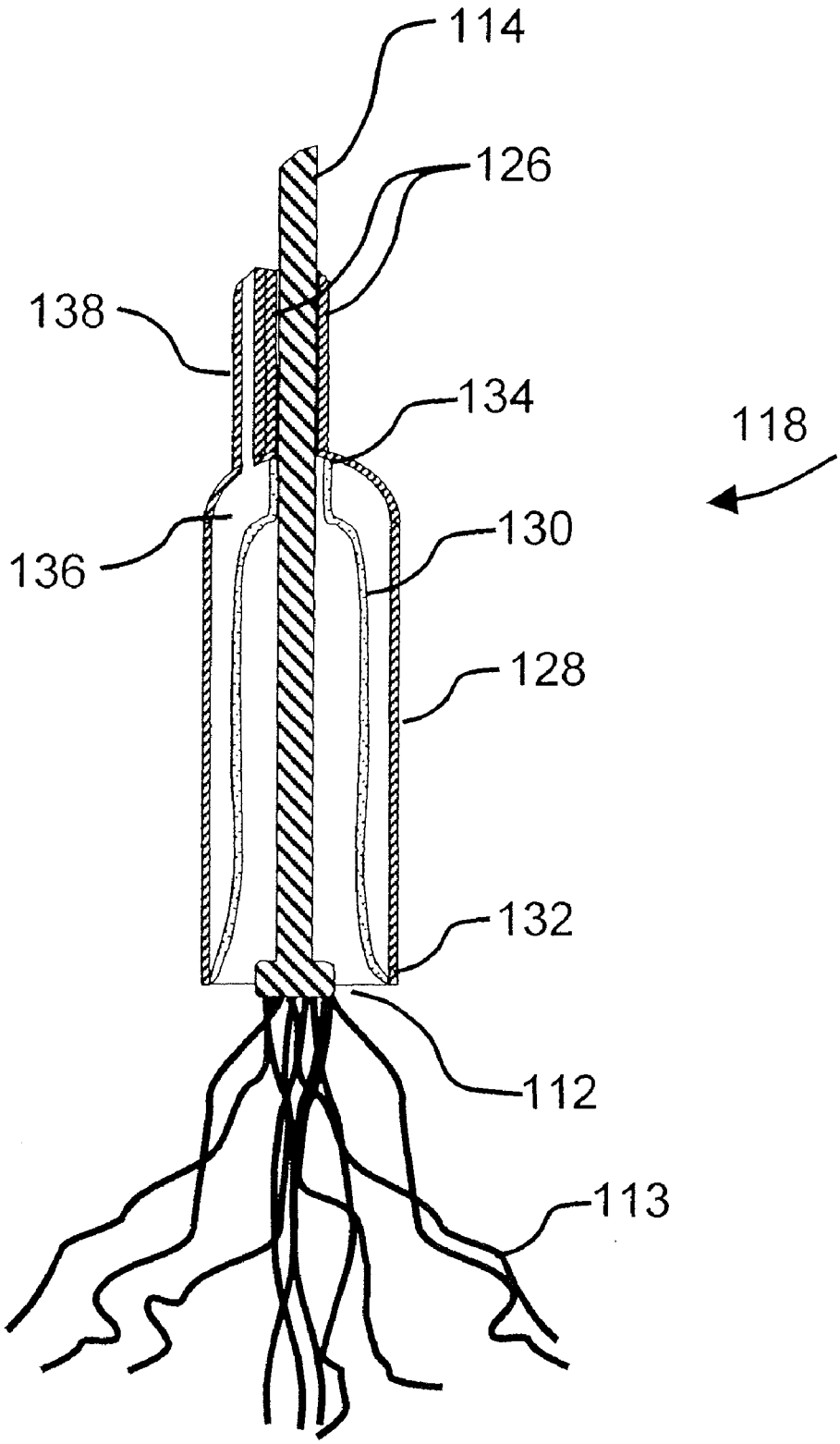
FIG. 7 is an enlarged, fragmentary, cross-sectional view taken through the cleaning apparatus of FIG. 5 illustrating the handle, sheath, and integral, expansible gas chamber thereof, with the sheath being positioned on the handle above the strands and the gas chamber being shown in a non-inflated condition.

Wringer assembly 118 includes a hand grip 124, connected by a spacer 126 to the closed upper end of a cylindrical sheath 128, with the hand grip, spacer and sheath all being sleeved on handle 114 and slideable relative thereto between the position of FIG. 5, wherein sheath 128 is positioned above cleaning head 112, and the position of FIG. 6, wherein sheath 128 sleeves cleaning head 112 and strands 113.

Sheath 128 has an open lower end, is non-porous and non-stretchable and has a flexible, sheath-like diaphragm 130 disposed therein.

Diaphragm 130 is sealed at its lower end 132 to the open lower end of sheath 128 and is sealed at its upper end 134 to the closed upper end of sheath 128 to provide an enclosed gas expansion chamber 136 within the sheath.

An air or gas conduit 138 connects between the lower end of cylinder 212 of pump assembly 116 and the upper end of sheath 128 of wringer assembly 118 and communicates with gas expansion chamber 136.

Figure 2:
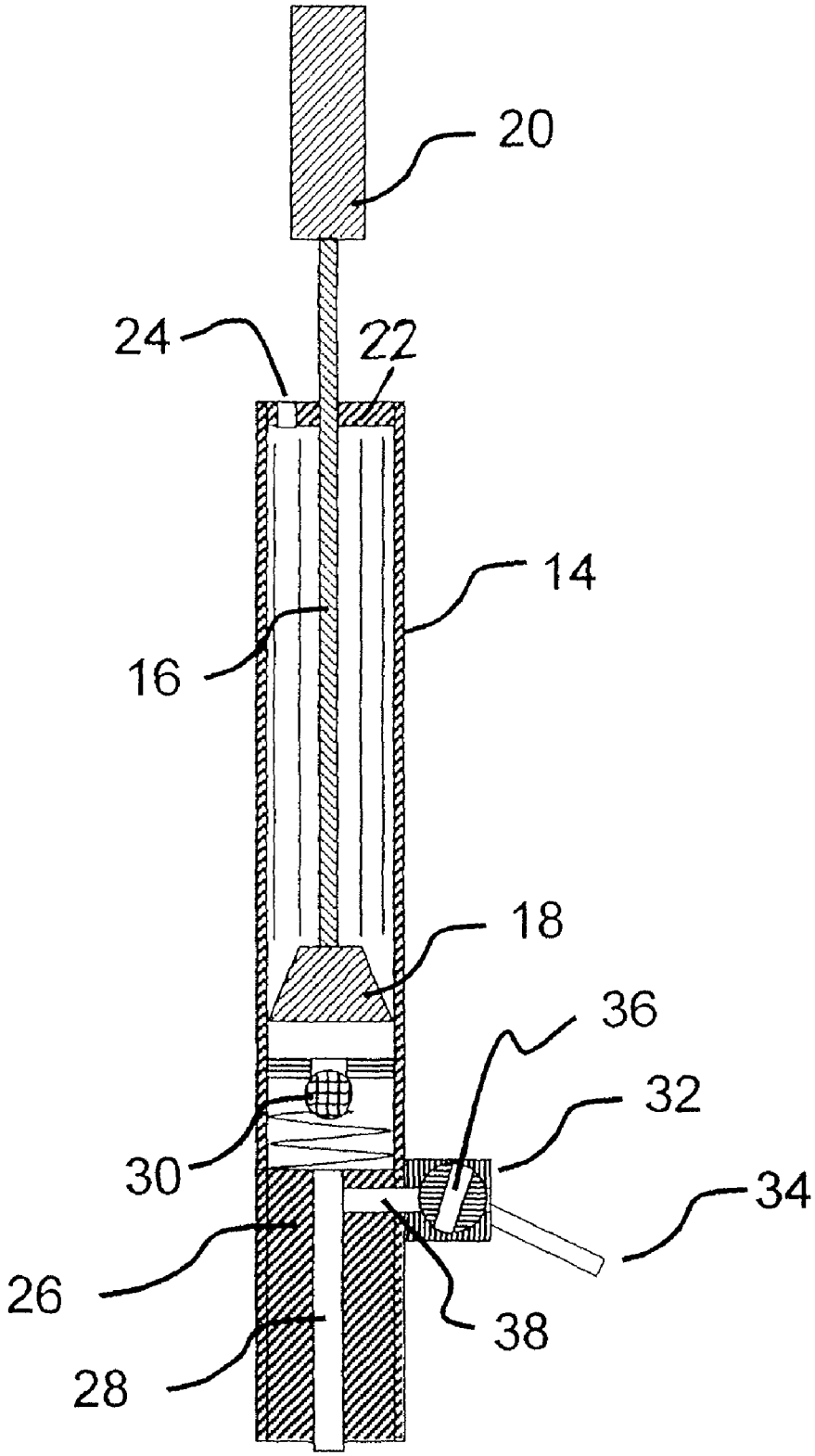
FIG. 2 is an enlarged, fragmentary, cross-sectional view taken through the handle and pump means of the cleaning apparatus of FIG. 1.
Figure 3:
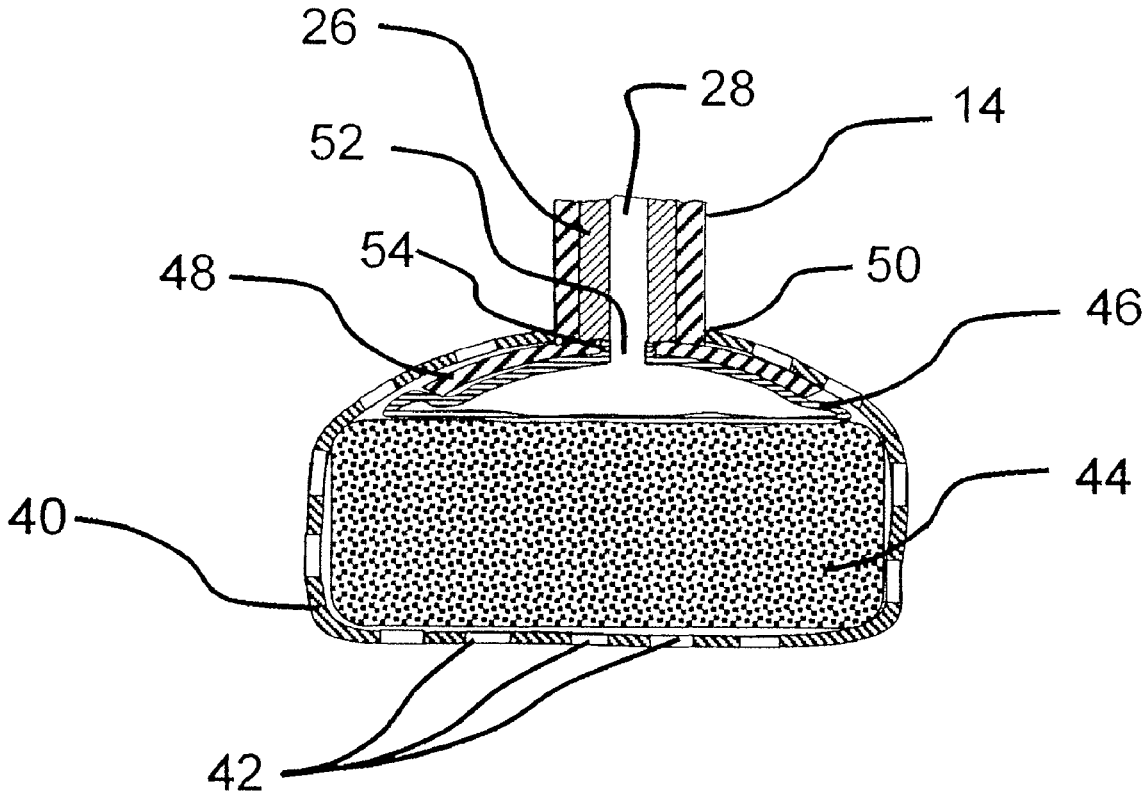
FIG. 3 is an enlarged, fragmentary, cross-sectional view taken through the cleaning member of the cleaning apparatus of FIG. 1 illustrating the handle, sheath, bladder and sponge of the cleaning member, the bladder being shown in a non-inflated condition, and the sponge being shown in a non-compressed condition.
Figure 4:
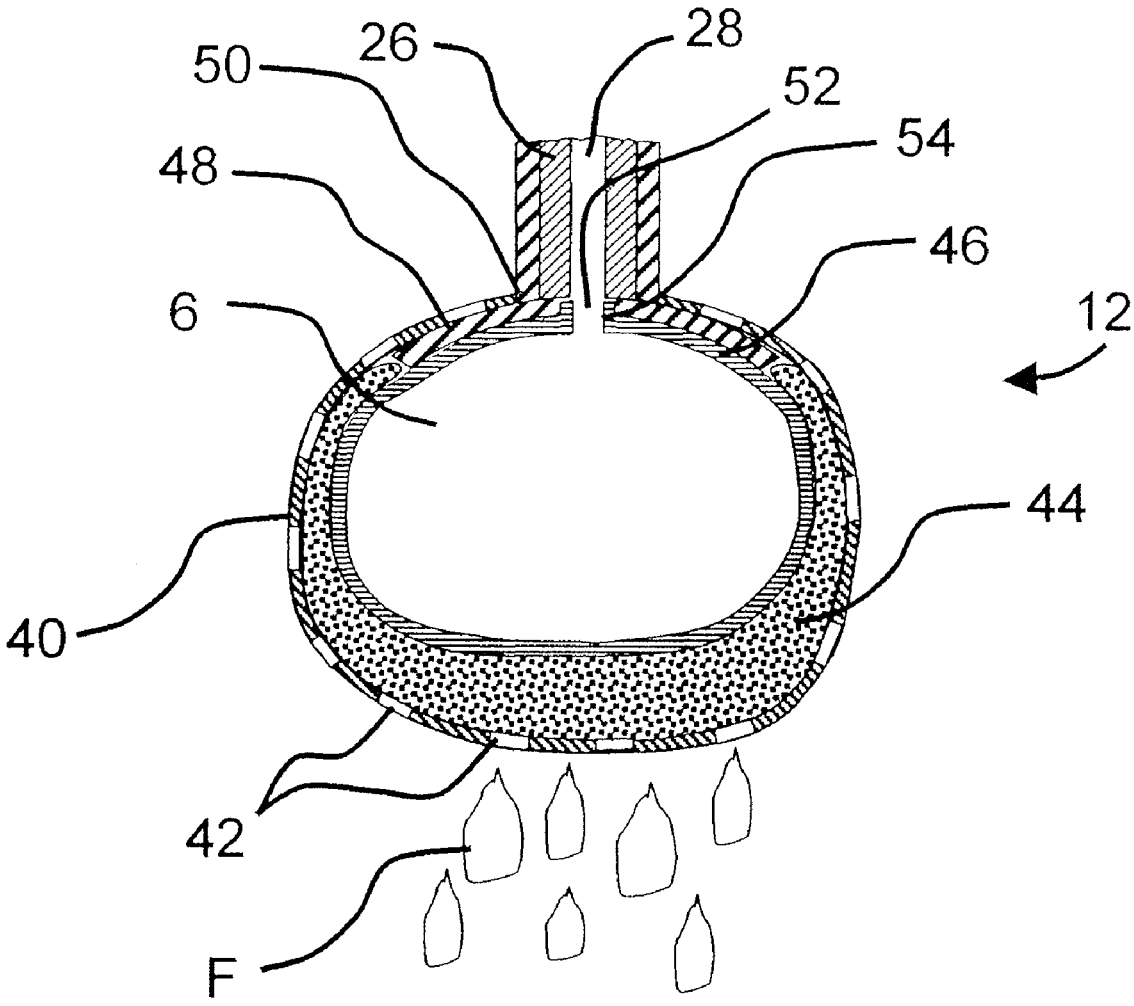
FIG. 4 is a fragmentary, cross-sectional view similar to FIG. 1, the bladder being shown in an inflated condition and the sponge being shown in a compressed condition for wringing fluid therefrom.

A three-way valve 115 similar to valve 32 of FIG. 2 is disposed on cylinder 122 of pump assembly 116 and is in communication with conduit 138 to direct air or gas from the pump assembly to gas expansion chamber 136 or from gas expansion chamber 136 of atmosphere.

Figure 8:
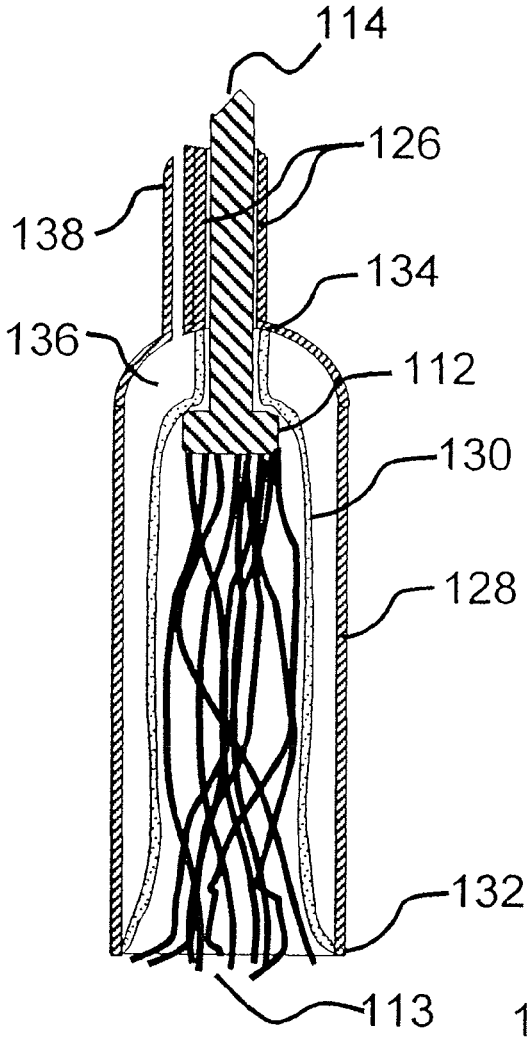
FIG. 8 is an enlarged, fragmentary, cross-sectional view similar to FIG. 7, with the strands now being partially encased by the sheath and with the gas chamber remaining in a non-inflated condition.

In operation, cleaning head 112 is extended and immersed in water or other fluid. To wring out the fluid from the strands 113, handle 114 is drawn up, while grasping hand grip 124, thus pulling the cleaning head and its strands 113 into gas expansion chamber 136 of wringer assembly 118 to the position as shown in FIG. 8.

Figure 9:
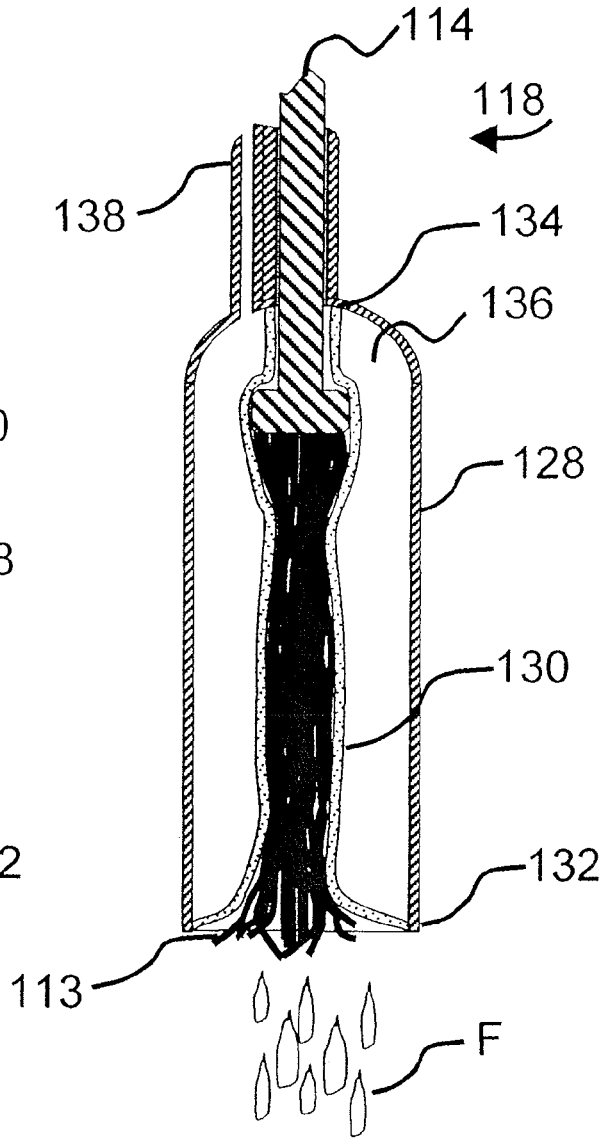
FIG. 9 is an enlarged, fragmentary, cross-sectional view similar to FIG. 8, following the introduction of compressed gas into the expansible gas chamber causing the flexible diaphragm thereof to expand inwardly thereby compressing the strands for wringing fluid therefrom.

Valve 115 is closed and pump assembly 116 is activated and compressed air or gas is forced through conduit 138 into the gas expansion chamber 136 causing diaphragm 130 to deflect inwardly toward cleaning head 112 to the position of FIG. 9, compressing strands 113 of the cleaning head to squeeze fluid F therefrom.

Figure 10:
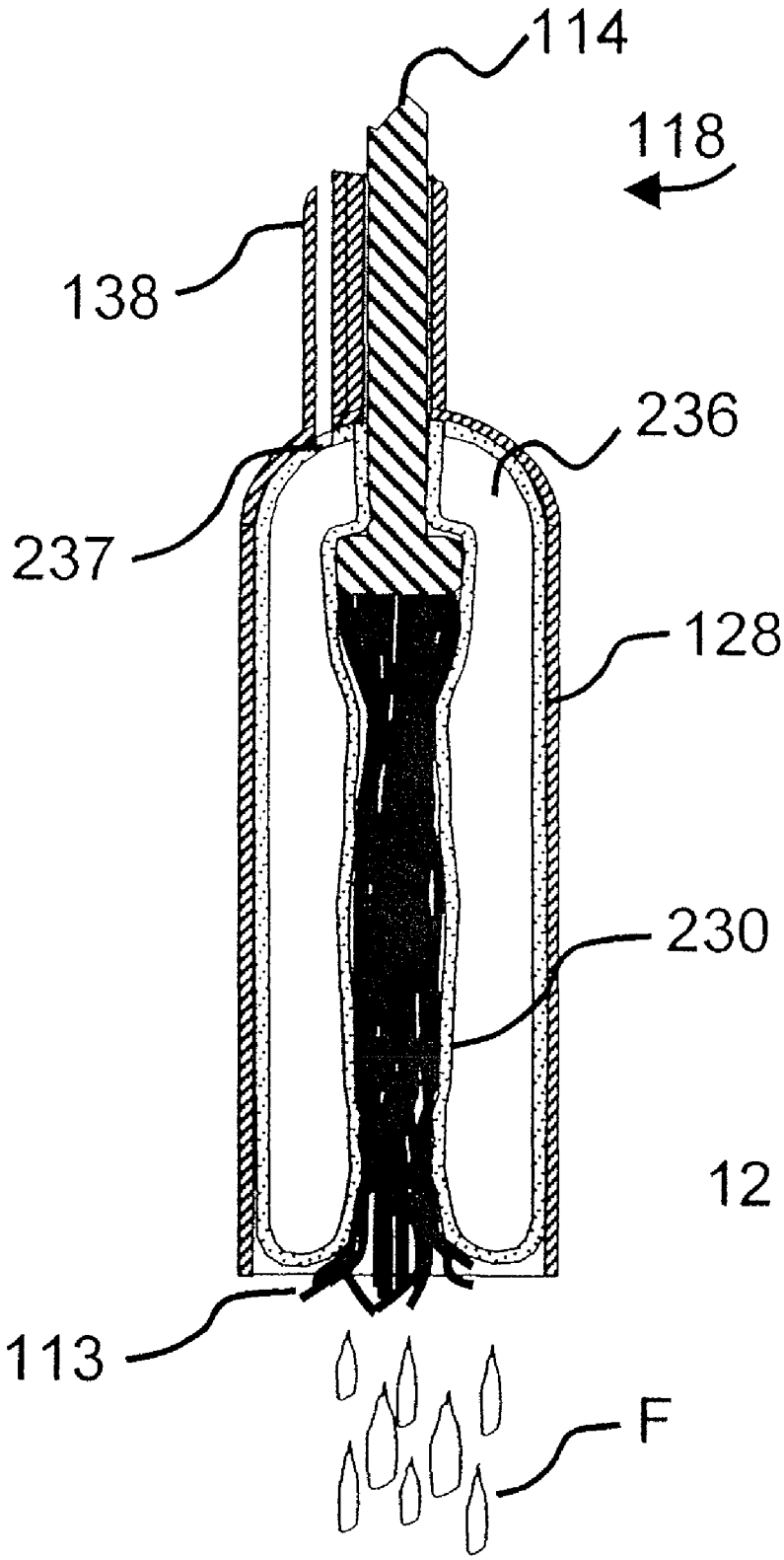
FIG. 10 is an enlarged, fragmentary, cross-sectional view similar to FIG. 9 of a second modified form of the invention as embodied in cleaning apparatus of the string-mop type.

In a second modified form of the invention as shown in FIG. 10 of the drawings, the flexible diaphragm 130 in sheath 128 of wringing assembly 118 of FIGS. 5-9 has been replaced by a bladder 230 which encases the strands 113 of the cleaning head, the bladder being in communication with conduit 138 for providing a gas expansion chamber 236 within sheath 128.

In this embodiment, when valve 115 is closed and pump assembly 116 is activated, compressed air or gas is forced through conduit 138 into gas expansion chamber 236 through port 237 causing bladder 230 to inflate and expand thereby compressing strands 113 of the cleaning head to squeeze fluid F therefrom.

What is claimed is:

1. A method for wringing a cleaning apparatus having a compressible cleaning member comprising the steps:

positioning the cleaning member adjacent an inflatable expansible member; said inflatable expansible member being in an uninflated condition;

enclosing the cleaning member and expansible member in encasing means comprising a flexible and porous sheath which defines the limits of expansion of the inflatable expansible member;

actuating a fluid inflating device; and inflating said inflatable expansible member so as to compress said cleaning member.

2. The method according to claim 1, further comprising the steps of attaching the cleaning member to a handle and attaching a pump to the handle and wherein the fluid inflating device for inflating the inflatable expansible member is the pump attached to the handle.

3. The method according to claim 1, wherein the encasing means enclosing the cleaning member and inflatable expansible member is a non-stretchable polymer sheath.

4. The method according to claim 1, wherein the cleaning member is a sponge.

5. The method according to claim 1, wherein the cleaning member is a string-type mop.

6. The method according to claim 1, wherein the inflatable expansible member is a bladder.

7. The method according to claim 1, wherein the inflatable expansible member is a gas chamber having a flexible diaphragm.

8. The method according to claim 1, further comprising the step of forming an aperture in the encasing means.

9. A method for wringing fluid from a hand held mop having a compressible fluid containing cleaning member comprising the steps:

positioning the cleaning member adjacent an inflatable expansible member; said inflatable expansible member being in an uninflatable condition; actuating a fluid inflating device; and inflating said inflatable expansible member so as to compress said cleaning member for wringing the fluid therefrom.

10. A method according to claim 9, further comprising the step of enclosing the cleaning member and inflatable expansible member in encasing means.

11. A method according to claim 10, wherein the encasing means limits expansion of the inflatable expansible member in the direction of the cleaning member.

* * * * *